United States Patent [19]

Torigian

[11] 4,138,052

[45] Feb. 6, 1979

[54] MULTI-LAYER TRAY DISPENSER PACKAGE

[76] Inventor: Puzant C. Torigian, 2 Horizon Rd., Fort Lee, N.J. 07024

[21] Appl. No.: 826,532

[22] Filed: Aug. 22, 1977

[51] Int. Cl.[2] ..... B65D 5/72

[52] U.S. Cl. ..... 229/17 B; 206/443; 206/561; 206/624; 229/44 R; 229/45 R

[58] Field of Search ..... 229/17 B, 11, 20, 44 R, 229/45; 206/528, 534.1, 443, 557, 362, 561, 558, 562, 563, 564, 585, 587, 589, 623, 624

[56] References Cited

U.S. PATENT DOCUMENTS

| | | | |
|---|---|---|---|
| 2,005,924 | 6/1935 | Wilson | 229/17 B |
| 2,331,754 | 10/1943 | Wohlers | 229/45 |
| 2,361,124 | 10/1944 | Ringholz | 229/45 |
| 2,847,119 | 8/1958 | Padura | 206/362 |
| 3,301,391 | 1/1967 | Guyer | 206/362 |
| 3,325,001 | 6/1967 | Rawlings | 206/362 |
| 3,356,279 | 12/1967 | Root | 229/17 B |
| 3,357,630 | 12/1967 | Michelitsch | 229/45 |
| 3,467,247 | 9/1969 | Weiss | 206/563 |

*Primary Examiner*—William T. Dixson, Jr.
*Assistant Examiner*—Bruce H. Bernstein
*Attorney, Agent, or Firm*—Jacobs & Jacobs

[57] ABSTRACT

A multi-layer tray dispenser package for fragile containers of pharmaceutical preparations such as ampoules of physiological saline are arranged in vertically superimposed trays for such containers in a box for storage and shipment, which box is provided with a weakened portion at one end which can be opened to provide an exit for a tray at that level. Each tray has a corrugated-like member for receiving ampoules out of contact with one another and each tray has longitudinal side members to facilitate sliding movement of the tray in the box and the lowermost tray has a bent over portion on which the tray immediately thereabove can slide.

7 Claims, 6 Drawing Figures

FIG. 1
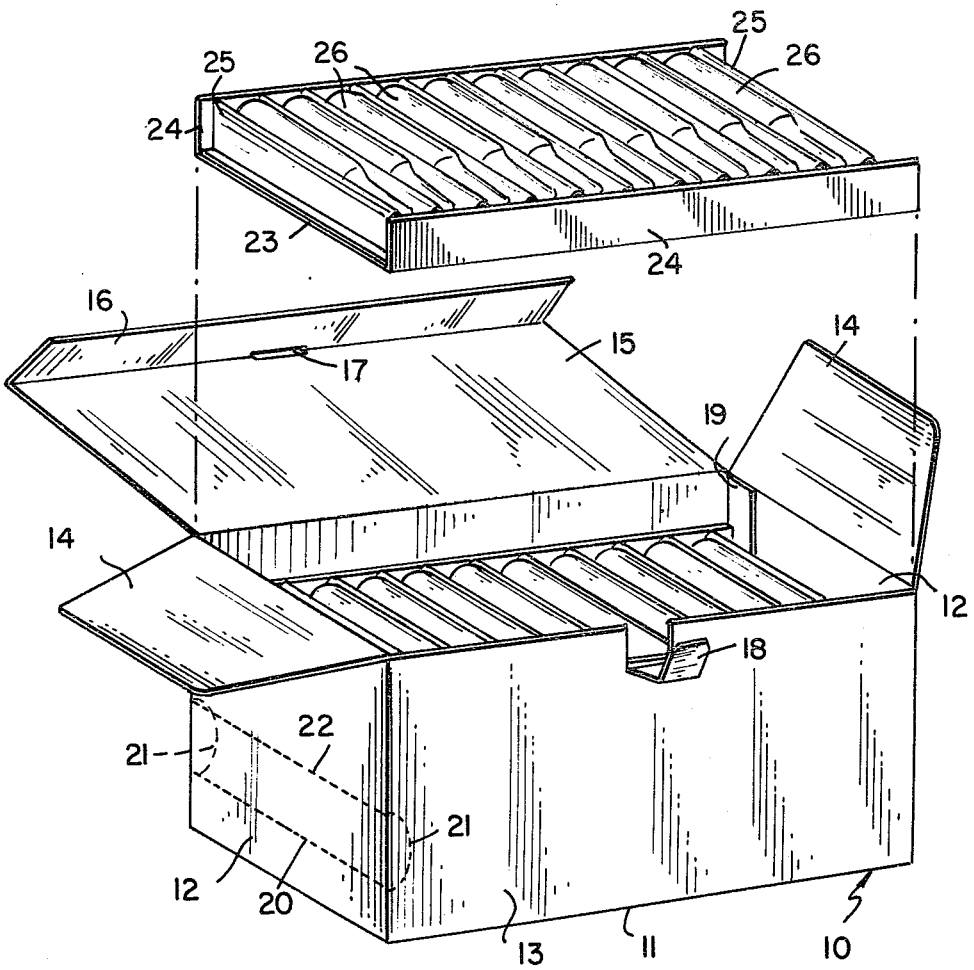
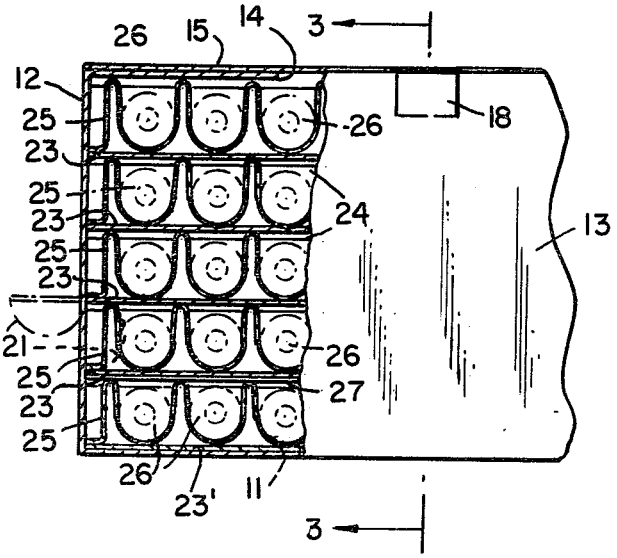
FIG. 2
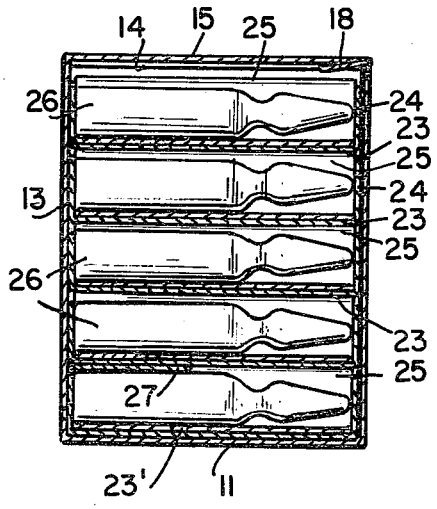
FIG. 3

FIG. 4
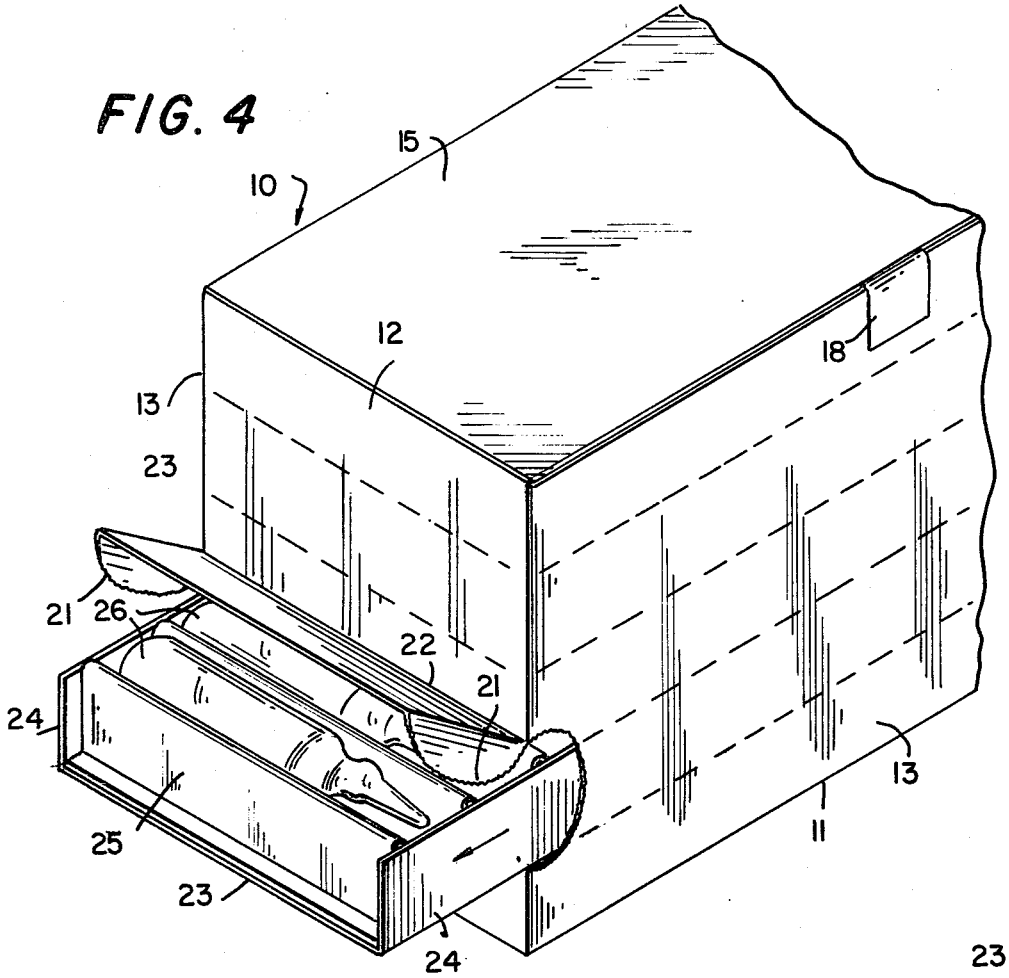
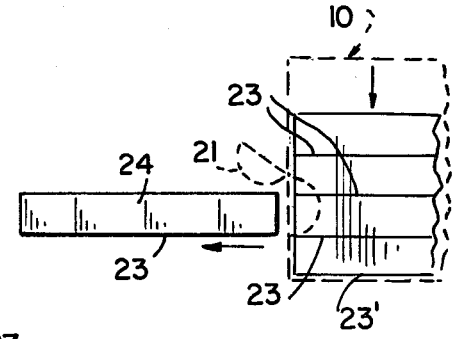
FIG. 6
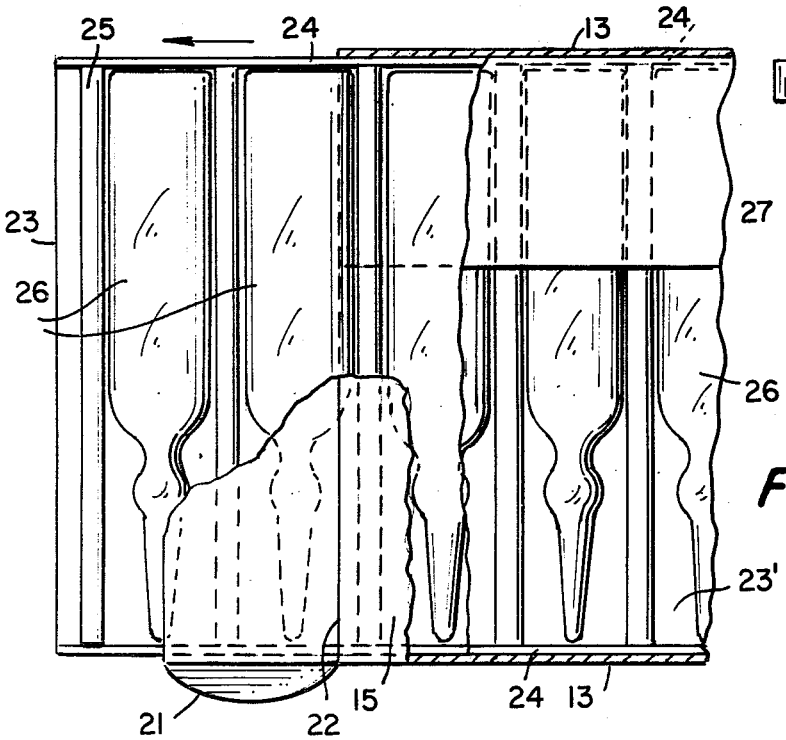
FIG. 5

MULTI-LAYER TRAY DISPENSER PACKAGE

SUMMARY OF THE INVENTION

A box of cardboard or heavy paper or other suitable cellulosic or non-cellulosic material, preferably highly calendared, is designed to receive a plurality of trays of the same material in vertically superimposed relationship and so dimensioned that they have a length and width substantially the same as the interior size of the box. The number of trays may vary depending on the height of the box and each tray, except for the lowermost tray, is provided with upstanding side portions extending the length of the tray and between which is a corrugated-like element for the reception in a transverse direction of a succession of sealed glass ampoules, each of which contains a predetermined amount of a physiological saline solution or other pharmaceutical preparation. Due to the side members, the tray slides easily out of the box as hereinafter described, and the lowermost tray has an inturned portion on which the tray just above can slide. One end of the box is provided with lines of weakening which make it possible to form an opening through which a tray at that level can slide outwardly. Means is provided for releasably holding the box closed.

DETAILED DESCRIPTION OF THE INVENTION

The dispenser package of the present invention is illustrated in the accompanying drawings wherein FIG. 1 is a disassembled view in perspective of a box and trays;

FIG. 2 is a fragmentary view partly in section and partly in elevation at about the mid point of the box of FIG. 1;

FIG. 3 is a sectional view taken at line 3,3 of FIG. 2;

FIG. 4 is a partial perspective view of the lefthand end of the box of FIG. 1 showing the manner in which a tray is slid out of the box;

FIG. 5 is an enlarged fragmentary view partly in plan showing details of the construction; and FIG. 6 is a diagrammatic detail view showing the manner in which the trays are arranged in the box and the removal of a tray from the box.

Referring to the drawings in detail, the numeral 10 designates a box of calendared cardboard or other suitable material having any desired length, width and depth and made up of a bottom panel 11, end panels 12, side panels 13 and flaps 14 at the upper end of the end panels 12. Side panel 13 has a cover member 15 adapted to act as a closure for the box and the cover member 15 has a longitudinal extension 16 which, when the box is closed, is adapted to fit snugly just inside the upper edge of the side panel 13. There is a slit 17 at the juncture of members 15 and 16 about midway of the length thereof and when the box is closed, the tongue 18 cut out of the central top portion of side panel 13 fits into slit 17 to hold the box in fully closed condition for storage, shipment, etc., but the box may be readily opened when it is desired to refill the same with additional trays of ampoules. The box is suitably cut out of a blank and has a flap 19 which is secured as by adhesive or other means on the inner surface of the adjoining end panel 12.

It will also be observed from FIGS. 1 and 4 in particular that one end panel 12 is provided with lines of weakening 20 extending across the entire end panel at a level equal to the position of a second tray on a lowermost tray and these lines of weakening extend around into the adjoining side panels 13 terminating in convex ends 21. The numeral 22 designates a fold line so that the weakened portion of the end panel can be moved to a horizontal or higher position, as particularly shown in FIG. 4, whereupon the tray may be slid out of the opening thereby formed.

The trays are of any suitable number as desired and each is made up of a bottom member 23 having upstanding longitudinal side portions 24 between which a corrugated-like element 25 is disposed with the corrugations transversely arranged with respect to the length of the tray and each semicircular space is adapted to receive therein an ampoule 26 which, for the sake of example, is a conventional sealed ampoule of glass containing a predetermined quantity of physiological saline solution although it is to be particularly understood that the invention is not limited to glass ampoules or to physiological saline solution since other fragile containers of medicaments or other substances may be substituted. Each of the trays is constructed and arranged as shown at the upper portion of FIG. 1 and there may be 2, 3, 4 or more such trays depending on the depth of the box and the particular package desired. This results in a multi-layer tray dispenser package particularly adapted for containers of pharmaceutical preparations, and the relative arrangement of the superimposed trays will be apparent from FIG. 2. The lowermost tray, however, designated 23', while otherwise constructed the same as each already described tray 23, is provided with an inturned flat extension 27 extending the full length of the lowermost tray along one side only, as it has been found to be unnecessary to provide such flat extension at both sides of the lowermost tray since the provision of the inturned flat extension 27 serves as an adequate support on which the next upper tray may easily slide. As will be observed from FIG. 4, when the weakened portion in one of the end panels 12 is pushed out or projected away from the end panel along lines of weakening 20 and 22, it can be raised to horizontal or higher level whereupon the tray resting on the lowermost tray can be readily slid outwardly to make the ampoules or pharmaceutical containers available for removal and use. The tray can be pulled out part at a time if desired or the entire tray may be removed from the box in which latter event the trays above the tray thus removed drop down into the box a vertical distance equal to the height of the removed tray and so on with respect to additional trays, the important consideration being that the tray to be removed from the box is at the level of the opening which has been formed by the movement of the weakened portion and, of course, if desired the box could be opened and additional trays inserted so as in effect to provide a continuous supply of trays and ampoules. It will be seen, however, that this does not apply to the lowermost tray which is blocked from removal by the unprojected lowermost part of end panel 20. When it is desired to remove such tray, then the unprojected panel portion is manually moved to a horizontal position level with the bottom of the box so that the bottom tray can be removed. This is optional, however, and if desired the lowermost tray may remain more or less permanently in place or may be filled with dummy or mock ampoules or vials or other containers or simulated containers. Eventually the box may be discarded if and when desired after serving its intended purpose.

What is claimed is:

1. A multi-layer tray dispenser package for fragile containers of pharmaceutical preparations which comprises an enclosure box having a depth sufficient to receive a plurality of vertically superimposed trays for such containers, a plurality of trays thus disposed in said box, an end panel of said box having vertically spaced lines of weakening above the box bottom defining a transverse section there across and partway of the contiguous portions of the box side panels, whereby said transverse section may be raised to horizontal or higher position without detaching it to provide an opening through which that tray can be slid out of the box which is at the level of the opening and the transverse section thereafter re-positioned flush with the end panel, there being a subjacent non-slidable tray having an inturned flat member along one side on which the tray thereabove to be slid out can slide and the tray to be slid out having upstanding vertical integral members along each side to facilitate sliding action of the tray, the subjacent tray being the lowermost tray and being blocked against sliding movement, each of the trays being dimensioned to be substantially equal in size to the length and width of the box and each tray being provided with a corrugated-like member resting on the tray bottom with the corrugations extending transversely of the tray to form recesses for the reception of a series of the fragile containers out of contact with one another.

2. A multi-layer tray dispenser package for containers of pharmaceutical preparations according to claim 1 which containers are ampoules, comprising an enclosure box adapted to receive a plurality of trays of such ampoules in superimposed vertically aligned position, a plurality of such trays of ampoules thus arranged in said box, said box having a bottom panel, and upstanding end and side panels, said end panels each having a flap foldable into a horizontal position over the trays and movable to a position which does not obstruct the introduction of trays into the box, one side panel having a cover portion terminating in a longitudinal extension dimensioned to fit interiorly of the upper edge of the other side panel and said side panels having intermediate their length means for releasably holding the cover and extension in assembled condition, the side panel having the cover portion terminating in a vertical flap sealed to the inner surface of the adjoining end panel and the other end panel having a weakened transverse section extending thereacross and partway of the contiguous portions of the side panels and adapted to be manually opened to form an exit opening for that tray of ampoules which is next above the lowermost tray, whereby when said weakened portion is opened, a tray of ampoules can be slid out therethrough and said tray being slidable on and along an inturned flat extension along one side of the lowermost tray and each such slidable tray having a vertically disposed longitudinally extending integral member along each side thereof to facilitate sliding movement thereof along the interior surfaces of the side panels and when a tray is slid out the next upper tray or trays drop down a corresponding vertical distance.

3. A multi-layer tray dispenser package for containers of pharmaceutical preparations according to claim 1 which containers are ampoules, comprising an enclosure box adapted to receive a plurality of trays of such ampoules in superimposed vertically aligned position, a plurality of such trays of ampoules thus arranged in said box, said box having a bottom panel, and upstanding end and side panels, said end panels each having a flap foldable into a horizontal position over the trays and movable to a position which does not obstruct the introduction of trays into the box, one side panel having a cover portion terminating in a longitudinal extension dimensioned to fit interiorly of the upper edge of the other side panel and said side panels having intermediate their length means for releasably holding the cover and extension in assembled condition, the side panel having the cover portion terminating in a vertical flap sealed to the inner surface of the adjoining end panel and the other end panel having a weakened transverse section extending thereacross and partway of the contiguous portions of the side panels and adapted to be manually opened to form an exit opening for that tray of ampoules which is next above the lowermost tray, whereby when said weakened portion is opened, a tray of ampoules can be slid out therethrough and said tray being slidable on and along an inturned flat extension along one side of the lowermost tray and each such slidable tray having a vertically disposed longitudinally extending integral member along each side thereof to facilitate sliding movement thereof along the interior surfaces of the side panels and when a tray is slid out the next upper tray or trays drop down a corresponding vertical distance, said ampoules being disposed transversely of the box and each resting in a separate U-shaped recess of a corrugated-like member in each tray such that the ampoules are out of contact with one another.

4. A multi-layer tray dispenser package for containers of pharmaceutical preparations according to claim 1 which containers are ampoules, comprising an enclosure box adapted to receive a plurality of trays of such ampoules in superimposed vertically aligned position, a plurality of such trays of ampoules thus arranged in said box, said box having a bottom panel, and upstanding end and side panels, said end panels each having a flap foldable into a horizontal position over the trays and movable to a position which does not obstruct the introduction of trays into the box, one side panel having a cover portion terminating in a longitudinal extension dimensioned to fit interiorly of the upper edge of the other side panel and said side panels having intermediate their length means for releasably holding the cover and extension in assembled condition, the side panel having the cover portion terminating in a vertical flap sealed to the inner surface of the adjoining end panel and the other end panel having a weakened transverse section extending thereacross and partway of the contiguous portions of the side panels and adapted to be manually opened to form an exit opening for that tray of ampoules which is next above the lowermost tray, whereby when said weakened portion is opened, a tray of ampoules can be slid out therethrough and said tray being slidable on and along an inturned flat extension along one side of the lowermost tray and each such slidable tray having a vertically disposed longitudinally extending integral member along each side thereof to facilitate sliding movement thereof along the interior surfaces of the side panels and when a tray is slid out the next upper tray or trays drop down a corresponding vertical distance, said ampoules being disposed transversely of the box and each resting in a separate U-shaped recess of a corrugated-like member in each tray such that the ampoules are out of contact with one another, each ampoule containing a sealed-in predetermined amount of physiological saline solution.

5. A multi-layer tray dispenser package for containers of pharmaceutical preparations according to claim 1 which containers are ampoules, comprising an enclosure box adapted to receive a plurality of trays of such ampoules in superimposed vertically aligned position, a plurality of such trays of ampoules thus arranged in said box, said box having a bottom panel, and upstanding end and side panels, said end panels each having a flap foldable into a horizontal position over the trays and movable to a position which does not obstruct the introduction of trays into the box, one side panel having a cover portion terminating in a longitudinal extension dimensioned to fit interiorly of the upper edge of the other side panel and said side panels having intermediate their length means for releasably holding the cover and extension in assembled condition, the side panel having the cover portion terminating in a vertical flap sealed to the inner surface of the adjoining end panel and the other end panel having a weakened transverse section extending thereacross and partway of the contiguous portions of the side panels and adapted to be manually opened to form an exit opening for that tray of ampoules which is next above the lowermost tray, whereby when said weakened portion is opened, a tray of ampoules can be slid out therethrough and said tray being slidable on and along an inturned flat extension along one side of the lowermost tray and each such slidable tray having a vertically disposed longitudinally extending integral member along each side thereof to facilitate sliding movement thereof along the interior surfaces of the side panels and when a tray is slid out the next upper tray or trays drop down a corresponding vertical distance, said weakened transverse section being shaped as a strip with convex ends and being liftable to a generally horizontal or higher position without completely detaching the section from its end panel, whereby the section may be repositioned to close the opening formed.

6. A multi-layer tray dispenser package for containers of pharmaceutical preparations according to claim 1 which containers are ampoules, comprising an enclosure box adapted to receive a plurality of trays of such ampoules in superimposed vertically aligned position, a plurality of such trays of ampoules thus arranged in said box, said box having a bottom panel, and upstanding end and side panels, said end panels each having a flap foldable into a horizontal position over the trays and movable to a position which does not obstruct the introduction of trays into the box, one side panel having a cover portion terminating in a longitudinal extension dimensioned to fit interiorly of the upper edge of the other side panel and said side panels having intermediate their length means for releasably holding the cover and extension in assembled condition, the side panel having the cover portion terminating in a vertical flap sealed to the inner surface of the adjoining end panel and the other end panel having a weakened transverse section extending thereacross and partway of the contiguous portions of the side panels and adapted to be manually opened to form an exit opening for that tray of ampoules which is next above the lowermost tray, whereby when said weakened portion is opened, a tray of ampoules can be slid out therethrough and said tray being slidable on and along an inturned flat extension along one side of the lowermost tray and each such slidable tray having a vertically disposed longitudinally extending integral member along each side thereof to facilitate sliding movement thereof along the interior surfaces of the side panels and when a tray is slid out the next upper tray or trays drop down a corresponding vertical distance, the means for releasably holding the cover and extension in assembled condition being comprised of a slit at the junction of the cover portion and its extension and a tongue cut out of the opposite side panel and fittable into said slit when the box is closed.

7. A multi-layer tray dispenser package for containers of pharmaceutical preparations according to claim 1 which containers are ampoules, comprising an enclosure box adapted to receive a plurality of trays of such ampoules in superimposed vertically aligned position, a plurality of such trays of ampoules thus arranged in said box, said box having a bottom panel, and upstanding end and side panels, said end panels each having a flap foldable into a horizontal position over the trays and movable to a position which does not obstruct the introduction of trays into the box, one side panel having a cover portion terminating in a longitudinal extension dimensioned to fit interiorly of the upper edge of the other side panel and said side panels having intermediate their length means for releasably holding the cover and extension in assembled condition, the side panel having the cover portion terminating in a vertical flap sealed to the inner surface of the adjoining end panel and the other end panel having a weakened transverse section extending thereacross and partway of the contiguous portions of the side panels and adapted to be manually opened to form an exit opening for that tray of ampoules which is next above the lowermost tray, whereby when said weakened portion is opened, a tray of ampoules can be slid out therethrough and said tray being slidable on and along an inturned flat extension along one side of the lowermost tray and each such slidable tray having a vertically disposed longitudinally extending integral member along each side thereof to facilitate sliding movement thereof along the interior surfaces of the side panels and when a tray is slid out the next upper tray or trays drop down a corresponding vertical distance, the means for releasably holding the cover and extension in assembled condition being comprised of a slit at the junction of the cover portion and its extension and a tongue cut out of the opposite side panel and fittable into said slit when the box is closed and the said slit and tongue being located about midway of the length of the box.

* * * * *